US006397026B1

(12) United States Patent
Buxton et al.

(10) Patent No.: US 6,397,026 B1
(45) Date of Patent: May 28, 2002

(54) APPARATUS AND METHODS FOR INCREASING BIAS FORCE ON OPPOSING PHOTOSENSITIVE MEMBER AND DEVELOPING MEANS

(75) Inventors: Patrick Andrew Buxton, Lexington; Geoffrey Kyle Canter, Richmond; Martin Victor DiGirolamo, Lexington; Michael John Dixon, Lexington; Mark Duane Foster, Lexington; Kristoffer Alan Hazen, Richmond; Donald Thomas Kral, Lexington; James Caro Lurton, Lexington; Kenneth Daniel Seevers, Lexington; Robert Francis Soto, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/669,081

(22) Filed: Sep. 25, 2000

(51) Int. Cl.[7] ..... G03G 15/00

(52) U.S. Cl. ..... 399/111; 399/113

(58) Field of Search ..... 399/109, 110, 399/111, 113, 114, 119

(56) References Cited

U.S. PATENT DOCUMENTS 5,749,027 A * 5/1998 Ikemoto et al. ..... 399/113

* cited by examiner

*Primary Examiner*—Arthur T. Grimley
*Assistant Examiner*—Hoang Ngo
(74) *Attorney, Agent, or Firm*—John A. Brady

(57) ABSTRACT

Methods and apparatus for increasing the bias force between a developer half and a cleaner half of a process cartridge are disclosed. One or more springs are interposed between the cleaner half and the developer half of the process cartridge. These springs are of sufficient strength to maintain a constant separation between the developer and the photosensitive member of the process cartridge. Sources of force other than springs, such as weights or elastic members may also be employed to provide and increase the bias force urging the developer and photosensitive member together.

21 Claims, 7 Drawing Sheets

APPARATUS AND METHODS FOR INCREASING BIAS FORCE ON OPPOSING PHOTOSENSITIVE MEMBER AND DEVELOPING MEANS

FIELD OF THE INVENTION

The present invention relates generally to process cartridges for electrophotographic image forming, and more particularly relates to increasing the bias force between photosensitive members and developers in such cartridges.

BACKGROUND OF THE INVENTION

A process cartridge used for the formation of electrophotographic images in devices such as printers, fax machines, word processors and photocopiers contains a photosensitive member and a developer. The developer carries toner by electrostatic and/or magnetic force to the photosensitive member and is specifically spaced from the photosensitive member such that toner will migrate from the developer to the photosensitive member by the force. The spacing between the developer and the photosensitive member must remain constant throughout the life of the cartridge so as to avoid varying the mass of toner transferred. By maintaining a steady mass of toner transferred between the developer and the photosensitive member, the print quality is improved. This spacing is generally controlled by a gap spacer or spacers located on the photosensitive member, the developer, or both.

A process cartridge generally consists of two halves swingably opposed to each other such that the spacers on the photosensitive member and/or the developer are in intimate contact with their opposing members but are not locked into position. The two swingably opposed halves may have slight rotational and/or translational movement with respect to each other. The halves are generally referred to as the cleaner half and the developer half The cleaner half contains the photosensitive member, and it also generally contains a photosensitive member cleaning system and a photosensitive member charging system. The developer half contains the developer and also generally contains the toner reservoir which supplies the developer with toner.

To maintain contact between the spacers and their opposing members, a bias force of some type is required. This bias force may come from the toner hopper mass, springs, or a combination thereof. In process cartridges relying on the toner hopper mass to maintain all or part of the bias force between the spacers and their opposing embers, the force decreases over time because the weight of the developer half decreases. In this condition, any movement of the developer half with respect to the cleaner half will influence the spacing between the photosensitive member and developer and, thus, influence print quality. Such a movement might arise from various sources such as misshapen photosensitive member gears, misshapen developer gears, uneven assembly of developer and/or photosensitive member gears, incorrect tolerances of components, low quality of components, dirt and debris, vibration, paper feed, alterations in the drive torque of the system, a twist of the system, or combinations of these and other sources of external or internal force.

These problems may be increased when used process cartridges are remanufactured for reuse and old components are replaced with new components that may not be designed or manufactured to the same specifications as the original components. Thus, both in original and remanufactured electrophotographic process cartridges, there exists a need for an improved means of maintaining a bias force to maintain a constant spacing between developers and photosensitive members.

SUMMARY OF THE INVENTION

In accordance with one aspect of the present invention, there is provided a method and apparatus for increasing the bias force between a cleaner half and a developer half of a process cartridge.

In one embodiment of the present invention, the bias force between a cleaner half and a developer half of a process cartridge is increased by placing shims adjacent to one or both ends of bias springs within a process cartridge.

In another embodiment of the present invention, bias springs having a high spring constant are used to increase the bias force between a cleaner half and a developer half of a process cartridge.

In another embodiment of the present invention, an external bias force is supplied between the two halves of the process cartridge either in addition to or instead of a bias force supplied from inside the cartridge. In one embodiment, springs are placed externally on the cleaner half, developer half, or both halves. In another embodiment, static weights are placed inside and/or outside the developer half and/or the cleaner half.

In another embodiment of the present invention, a bias force between the cleaner half and the developer half of a process cartridge is increased by mounting one or more elastic members on the cleaner half or developer half. In this embodiment, the elastic member or members abut either the cleaner half, the developer half or both halves and a printing apparatus so as to increase the bias force between the halves.

BRIEF DESCRIPTION OF THE DRAWINGS

The foregoing and other advantages of the invention will become apparent upon reading the following detailed description and upon reference to the drawings in which.

Figure 1:
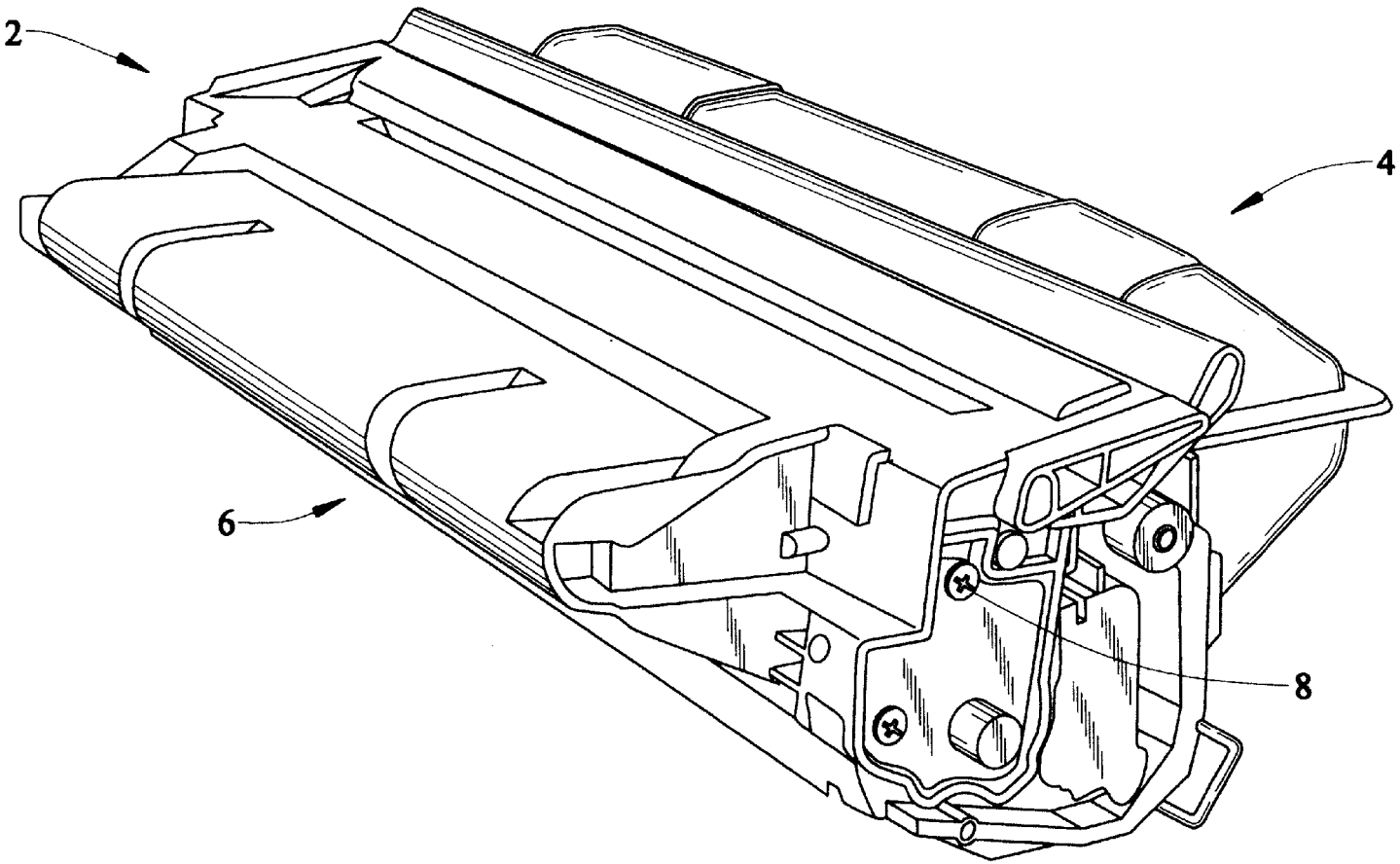
FIG. 1 is a perspective view of a process cartridge for use with the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the intent is to cover all modifications, equivalents, and alternatives falling within the spirit and scope of the invention as defined by the appended claims.

DETAILED DESCRIPTION OF THE INVENTION

Turning now to the drawings and referring initially to FIG. 1, there is depicted a process cartridge 2 of the type utilized in the present invention. The process cartridge 2 has a developer half 4 and a cleaner half 6. The developer half 4 and the cleaner half 6 are rotatably connected via a pivot bar 8.

Figure 2:
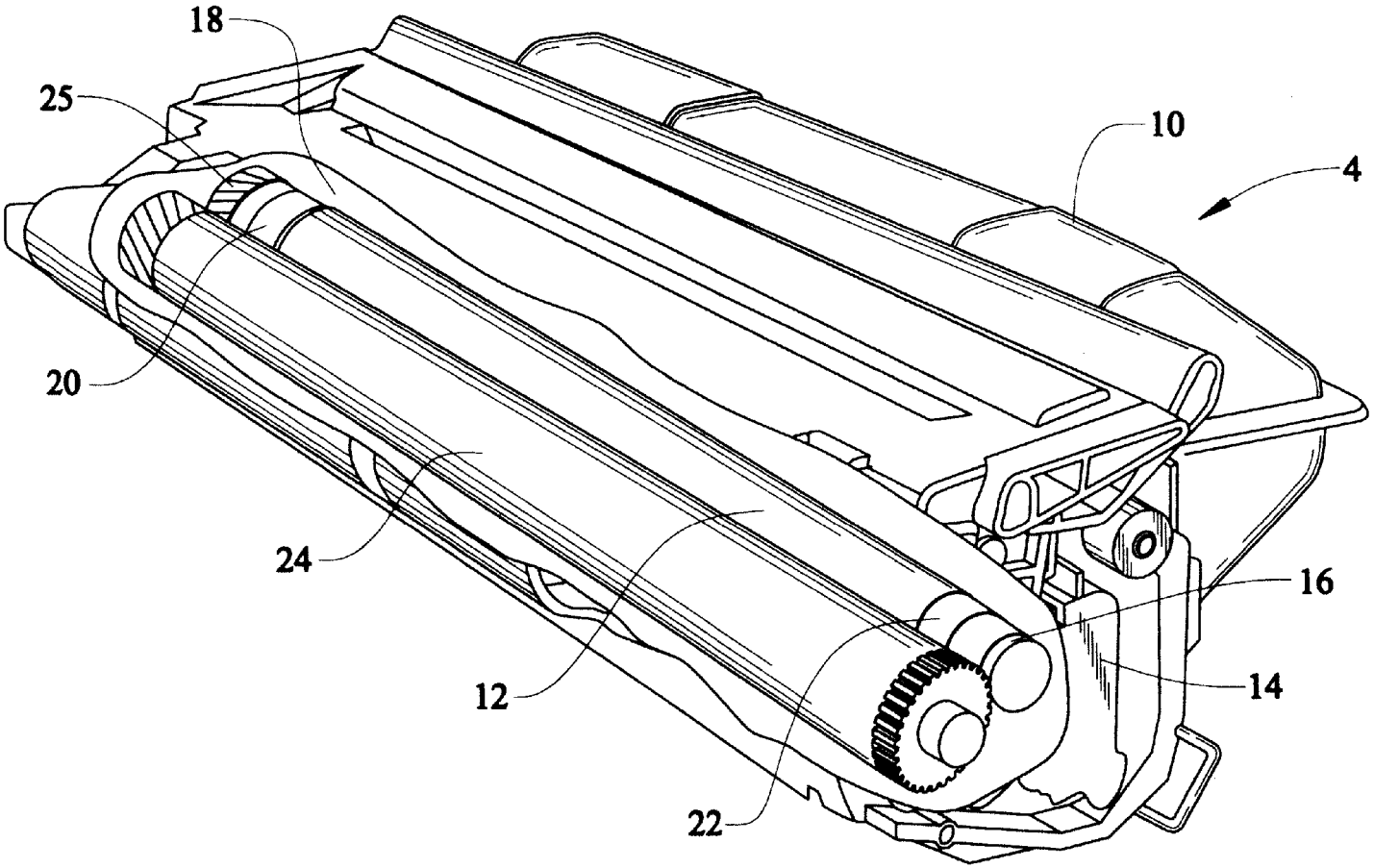
FIG. 2 is a perspective view of a developer half of a process cartridge for use with the present invention.

As shown in FIG. 2, the developer half 4 includes a toner bin 10 and a developer 12. The developer 12 is rotatably connected to a developer half frame 14 by one or more hubs or gears 16. The toner bin 10 contains toner, a powdery ink which is fused to print media to form an electrophotographic image. When one embodiment of a process cartridge 2 is in use, toner is transferred from the toner bin 10 to the developer 12 as the developer 12 rotates. Toner is held on the developer 12 by magnetic force, electrostatic force, or a combination thereof. To assist in maintaining a smooth and consistent level of toner on the developer 12, the process cartridge may include a doctor blade 18. In one embodiment, the developer 12 includes gap spacers 20 and 22 at both ends.

Figure 3:
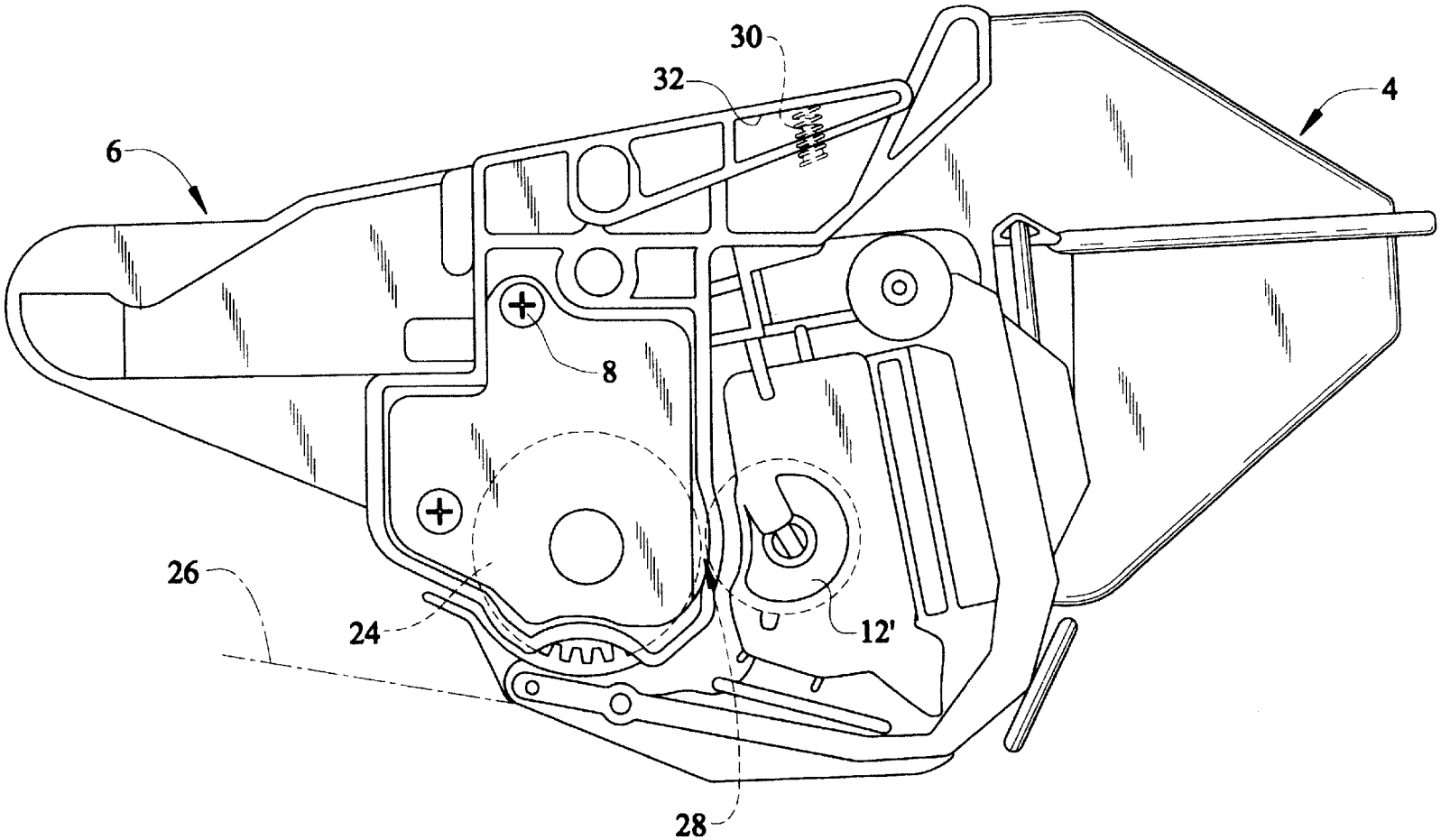
FIG. 3 is a side view of a process cartridge utilizing the present invention.

To produce an electrophotographic image on print media, toner must be transferred from the developer 12 to a photosensitive member 24 as shown in FIG. 3. In one embodiment, the photosensitive member is rotated by a motor. In turn, the developer 12 may be rotated via a gear 25 connected to the photosensitive member, as shown in FIG. 2.

The photosensitive member 24 is a drum coated with a photosensitive material that conducts electricity in the presence of light of the proper wavelength. In a laser printer, for example, the photosensitive member is charged by charging means and a pattern of laser light corresponding to the image to be printed is shone onto the photosensitive member as the photosensitive member 24 rotates. The charging means may be a wire carrying a current or other charging means, such as a charge roller, and the laser light may be produced by a single laser directed to the photosensitive member 24 via one or more prisms or by several laser diodes directed toward the photosensitive member 24. The resulting charge pattern on the photosensitive member 24 causes toner to be transferred from the developer 12 onto the photosensitive member 24 as the photosensitive member 24 rotates past the smooth layer of toner on the developer 12. The toner is transferred only to the points on the photosensitive member 24 that have been discharged by laser light exposure. To complete the printing process, the toner is transferred from the photosensitive member 24 to print media 26 and fused to the print media 26 by fusing means, which may include rollers which fuse the toner to the print media 26 via pressure, heat, or both.

Because a smooth and consistent amount of toner should be transferred from the developer 12 to the photosensitive member 24 when they rotate, the gap 28 between the developer 12 and the photosensitive member 24 should be maintained at a constant width. The gap spacers 20 and 22, which surround the developer 12 near both ends of the developer, serve to maintain this constant width. In alternative embodiments, gap spacers may be attached to the photosensitive member 24, or the gap spacers may be attached both to the developer 12 and to the photosensitive member 24.

For the gap spacers 20 and 22 to provided a constant width for the gap 28, the gap spacers 20 and 22 should be maintained in close contact with their opposing members. More particularly, gap spacers attached to the developer 12 must be maintained in contact with the opposing photosensitive member 24 or projections thereof, and gap spacers attached to the photosensitive member 24 must be maintained in contact with the opposing developer 12 or projections thereof. To maintain this contact, a bias force should be provided between cleaner half and the developer half of the cartridge such that the developer 12 and the photosensitive member 24 are urged toward each other. Alternatively, the force may be provided between other parts or portions of the cartridge as long as the force tends to urge the developer 12 and photosensitive member 24 together.

One method of providing a bias force urging the developer 12 and the photosensitive member 24 together is to provide one or more compression springs 30 between the developer half 4 and the cleaner half 6. In one embodiment, the compression springs 30 are interposed between the developer half 4 and a projection 32 of the cleaner half 6. When one or more compression springs 30 are so situated, the pivot bar 8 holding the two halves of the cartridge 2 together serves as a fulcrum. The force from a compression spring 30 which urges the two cartridge halves apart at the spring location is thereby transformed into a leveraged force pushing the photosensitive member 24 toward the developer 12. Thus, the photosensitive member 24 and the developer 12 are urged toward each other and the gap spacers 20 and 22 are allowed to maintain a constant width for the gap 28.

The maintenance of a constant width for the gap 28 is mad e more difficult by forces which tend to alter the gap width. Sources of such forces include, for example, misshapen gears in the process cartridge 2, uneven assembly of the developer 12 and/or the photosensitive member 24 and/or their gears, incorrect tolerances of components, low quality of components, dirt and debris, vibration, paper feed, alterations of drive torque in the system, a twist of the system, or combinations thereof. It is desirable to increase the bias force urging the developer 12 and the photosensitive member 24 toward each other so that these internal or external forces which might serve to jar or separate the developer 12 and the photosensitive member 24 are counteracted.

Figure 4:
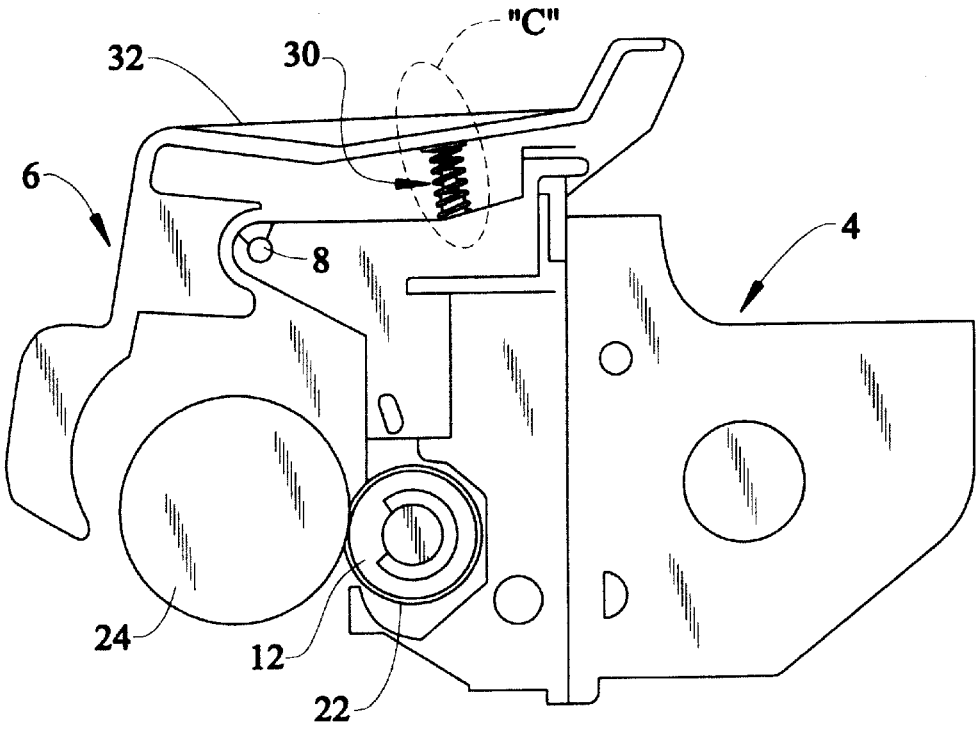
FIG. 4 is a side view of the components of a process cartridge utilizing one embodiment of the present invention.
Figure 5:
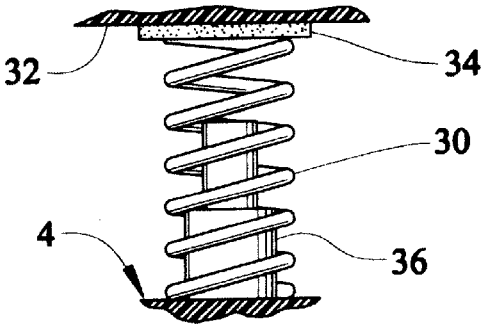
FIG. 5 is a magnified view of box "C" of FIG. 4.

Turning t o FIGS. 4 and 5, one method for increasing this force is depicted. FIGS. 4 displays a shim 34 placed between a compression spring 30 and the projection 32 of the cleaner half 6. This arrangement is shown in more detail in FIG. 5. As shown in FIG. 5, the compression spring 30 surrounds a generally cylindrical projection 36 of the developer half 4. The compression spring 30 is compressed by the shim 34 placed against the projection 32 of the cleaner half 6. The compression resulting from the shim 34 is greater than the compression of the compression spring that would result in the absence of the shim. Because the force exerted by a compression spring is expressed as:

$$F_{Spring}=kx$$

where k is the spring constant of the compression spring and x is the linear distance of compression, increasing the linear distance of compression increases the force exerted by the compression spring 30 and thus increase s the force urging together the developer 12 and the photosensitive member 24.

In an alternative embodiment, the shim 34 may be placed between the compression spring 30 and th e developer half 4. In another embodiment, two shims may be placed abutting the compression spring 30, one on the developer half 34 and the other on the cleaner half 6. The described methods for increasing the force exerted by a compression spring may be employed for some or all of the compression springs 30 used to exert a bias force in the process cartridge 2.

In all embodiments employing a shim or shims to increase the bias force, the shim or shims may be mounted using any of a number of methods including friction, glue, tape, heat welding, ultrasonic welding, screwing, riveting or any other fastening method.

Figure 6:
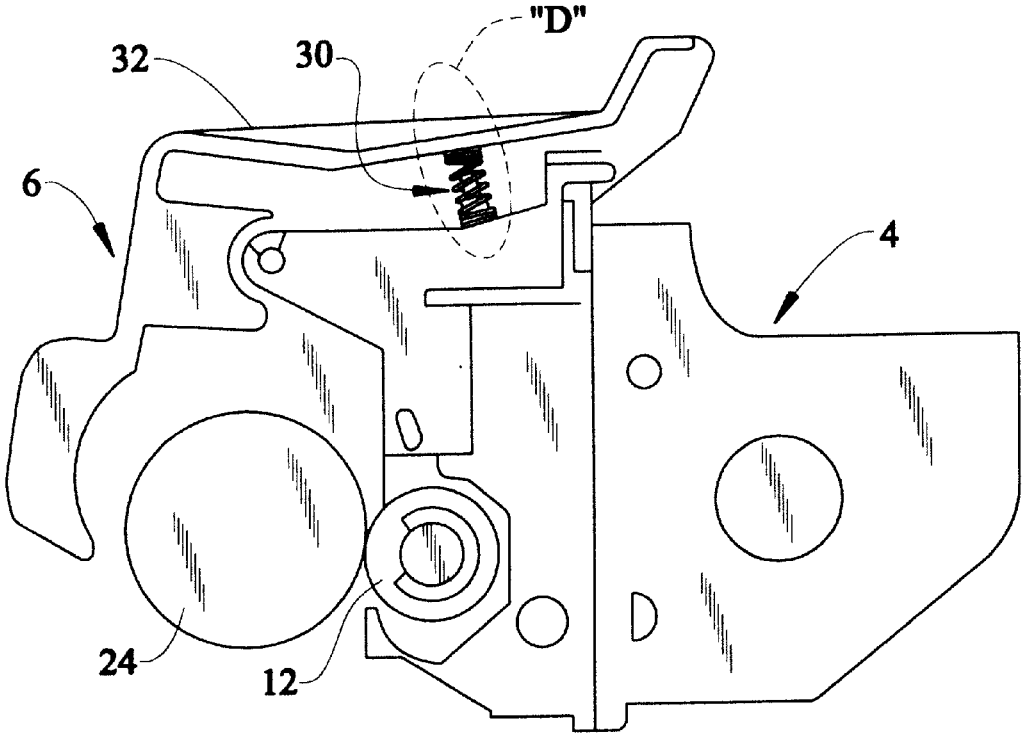
FIG. 6 is a side view of the components of a process cartridge utilizing another embodiment of the present invention.
Figure 7:
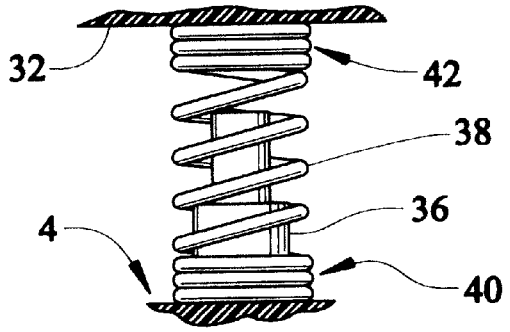
FIG. 7 is a magnified view of box "D" of FIG. 6.

Another method of the present invention for increasing the bias force urging the developer 12 and the photosensitive member 24 together is to increase the number of active or inactive coils of a compression spring 38, as shown in FIGS. 6 and 7. Active coils of a compression spring are those coils which contract together when the compression spring is compressed, and inactive coils are those coils which remain equidistant from each other when the compression spring is compressed. FIG. 6 displays a compression spring 38 having a number of inactive coils interposed between the developer half 4 and the projection 32 of the cleaner half 6. FIG. 7 shows in more detail the compression spring 38 and its inactive coils 40 and 42. The compression spring 38 is held in place by the generally cylindrical projection 36 of the developer half 4.

As indicated by the spring force equation, above, another method of increasing the force exerted by a spring is to increase the spring constant, k. The spring constant can be increased by increasing the number of inactive coils (as described above), increasing the number of active coils, constructing the spring of a material having greater tensile strength, increasing the diameter of the wire used to construct the spring, heat treating or tempering the spring material, pre-tensioning the spring, altering the spring geometry, and/or a variety of other methods. To achieve a greater bias force, it is possible to increase both the spring constant and the compression of a compression spring. Returning to FIG. 5, the force exerted by the spring 30 may thus be increased further by increasing the spring constant as described.

Increasing the bias force in the manner described above is useful both in newly manufactured process cartridges and in remanufactured process cartridges. In a remanufactured cartridge, for example, existing components are often reused and aggressive methods of separating the toner bin 10 and the developer 12 to refill the toner bin by cutting, slicing and/or cracking reduce the structural rigidity of the process cartridge 2. When the structural rigidity of the process cartridge 2 is reduced, the cartridge becomes more prone to twisting, warping, and deformation and more vulnerable to other forces which negatively affect the uniformity of the gap 28 between the photosensitive member 24 and the developer 12. Thus, increasing the bias force to maintain the width of the gap 28 becomes particularly important for remanufactured process cartridges.

It should be noted that many designs of process cartridges exist, and that some designs have cartridge halves containing different components from the cartridge halves described in the above examples. The present invention is directed to providing a bias force urging together a developer and a photosensitive member in any design of process cartridge, and this force may be applied to halves of the cartridges containing different components from the halves described. In addition, the bias forces may be applied to the developers and/or photosensitive members themselves rather than to halves of the cartridges.

When remanufacturing process cartridges, increasing an existing bias force by at least approximately 10% has been found to improve print quality. For example, some existing process cartridges have springs exerting a force of approximately 14 N. Higher print quality in both newly manufactured process cartridges and remanufactured process cartridges can be achieved by increasing this spring force by at least approximately 10%. Spring forces between approximately 15 N and approximately 28 N have been found to improve print quality, with substantial print quality improvement being achieved with a spring force of approximately 23 N. Referring to the bias force urging the developer 12 and the photosensitive member 24 together, bias forces of approximately 10 N, when increased to between approximately 10.7 N and approximately 20 N have been found to improve print quality, with substantial print quality improvement being achieved with a bias force of approximately 16.4 N.

Figure 8:
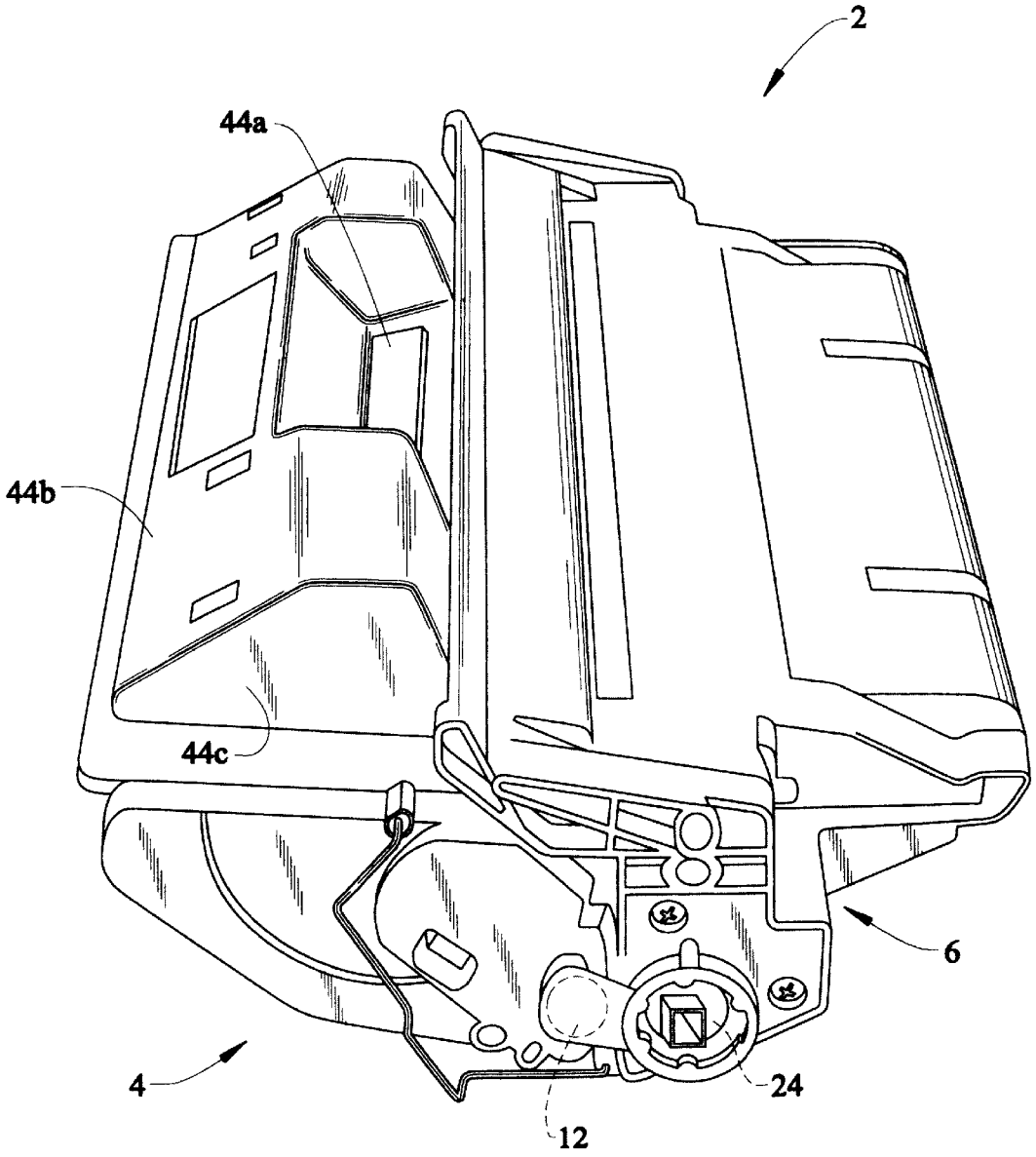
FIG. 8 is a perspective view of a process cartridge utilizing one embodiment of the present invention.

FIG. 8 displays one alternative embodiment of the present invention. As shown in FIG. 8, weights 44*a*, 44*b* and/or 44*c* may be added to the developer half 4 of the process cartridge 2. The weights 44*a*, 44*b* and/or 44*c* provide downward force on the developer half 4, thereby urging the developer 12 toward the photosensitive member 24. Such weights may be placed in other locations, including other locations inside or outside the process cartridge 2.

Figure 9:
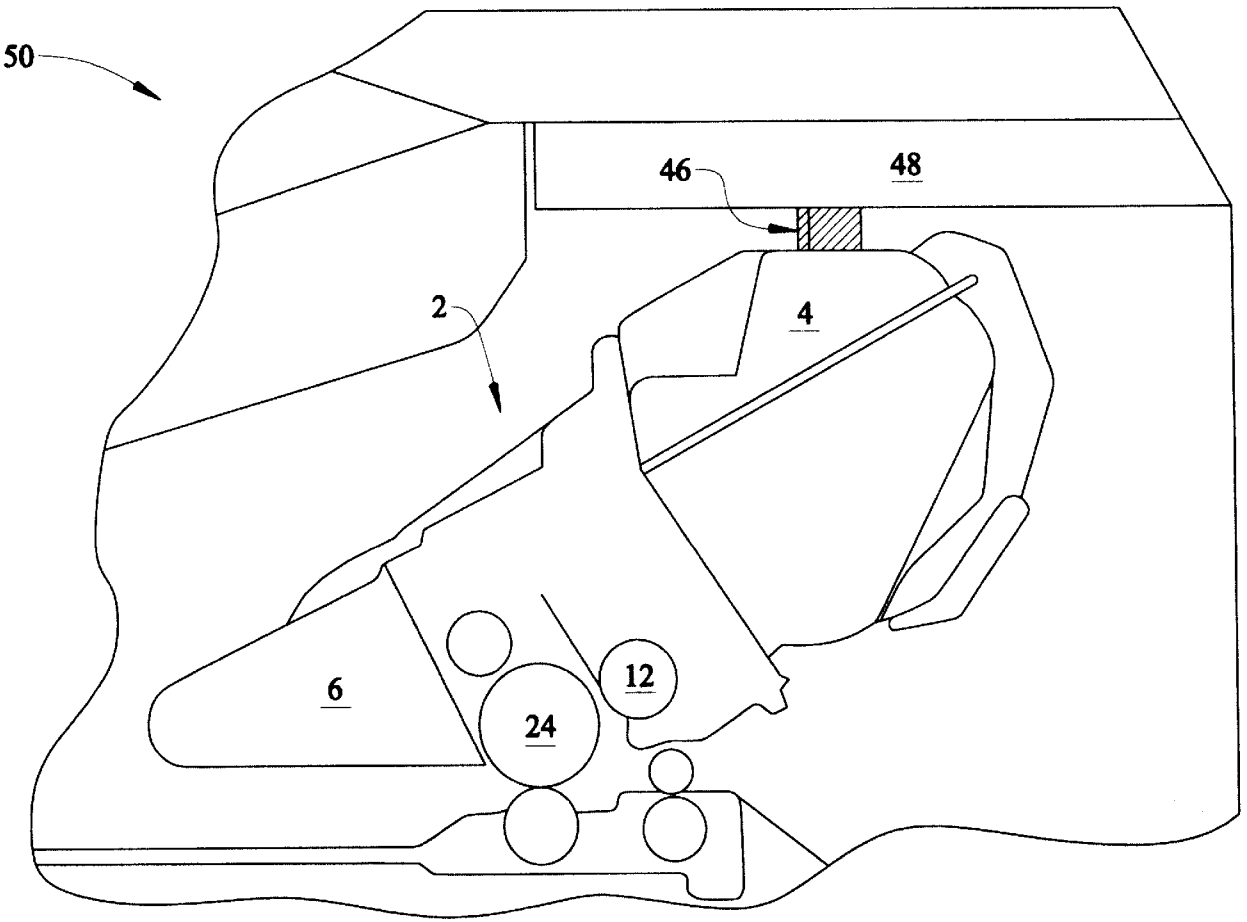
FIG. 9 is a side view of a process cartridge mounted in a printer and utilizing another embodiment of the present invention.

Another alternative embodiment of the present invention is shown in FIG. 9. FIG. 9 shows an elastic member 46 connected to the cleaner half 4 of the process cartridge 2. The elastic member 46 pushes down against the developer half 4 of the process cartridge 2, when a printer cover 48 is closed, thereby urging the developer 12 toward the photosensitive member 24. The elastic member 46 may be a piece of resilient foam, for example.

In another embodiment of the present invention, springs or other members providing a bias force urging the developer 12 and photosensitive member 24 together are repositioned to increase the bias force.

While the present invention has been described with reference to one or more particular embodiments, those skilled in the art will recognize that many changes may be made thereto without departing from the spirit and scope of the present invention. Each of these alternative embodiments and obvious variations thereof is contemplated as falling within the spirit and scope of the claimed invention, which is set forth in the following claims.

What is claimed is:

1. The method of manufacturing a process cartridge comprising:

providing a process cartridge having a developer, a photosensitive member, and one or more bias springs urging the developer and the photosensitive member together with an original bias force, the method comprising:

placing one or more shims abutting the bias springs to compress the bias springs and increase the original bias force between the developer and the photosensitive member to an increased bias force, wherein the increased bias force is at least about 10% greater than the original bias force.

2. The method of claim 1, wherein the increased bias force is at least about 50% greater than the original bias force.

3. The method of claim 1, wherein the original bias force produced at a location of the bias springs is approximately 14 N and the increased bias force is from approximately 15 N to approximately 28 N.

4. The method of claim 1, wherein said process cartridge is a previously used process cartridge.

5. A method of manufacturing a process cartridge comprising:

providing a process cartridge having a developer half, a cleaner half, and an origin bias force between the developer half and the cleaner half, and increasing the original bias force between the developer half and the cleaner half to an increased bias force at least about 10% greater than the original bias force.

6. The method of claim 5, wherein the original bias force is provided by one or more springs and increasing the bias force is accomplished by adding springs between the developer half and the cleaner half.

7. The method of claim 5, wherein the original bias force is provided by one or more springs and increasing the bias force is accomplished by adding shims abutting one or more of the springs.

8. The method of claim 5, wherein the process cartridge is a used process cartridge and the original bias force is provided by one or more original springs and increasing the bias force is accomplished by replacing one or more of the original springs with new springs having more inactive coils than the original springs.

9. The method of claim 5, wherein the process cartridge is a used process cartridge and the original bias force is provided by one or more original springs and increasing the bias force is accomplished by replacing one or more of the original springs with one or more new springs having higher spring constants than the original springs.

10. The method of claim 11, wherein the new springs have more active coils than the original springs.

11. The method of claim 11, wherein the new springs have more inactive and more active coils than the original springs.

12. The method of claim 1, wherein the new springs are formed of material having a higher tensile strength than a material used to form the original springs.

13. A remanufactured process cartridge comprising:

a photosensitive member;

a developer disposed approximately parallel to the photosensitive member and adapted to provide toner to the photosensitive member;

initial bias force means for producing a bias force urging the developer toward the photosensitive member; and additional bias force means for increasing the bias force urging the developer toward the photosensitive member, wherein the additional bias force means is one or more elastic members.

14. The process cartridge of claim 13, wherein the elastic members are disposed inside the cartridge.

15. The process cartridge of claim 13, wherein the elastic members are disposed outside the cartridge.

16. A remanufactured process cartridge comprising:

a photosensitive member;

a developer disposed approximately parallel to the photosensitive member and adapted to provide toner to the photosensitive member;

initial bias force means for producing a bias force urging the developer toward the photosensitive member; and additional bias force means for increasing the bias force urging the developer toward the photosensitive member, wherein the initial bias force means comprises elastic member disposed at multiple points in the process cartridge and the additional bias force means are disposed at points other than the multiple points.

17. A remanufactured process cartridge comprising:

a photosensitive member;

a developer disposed approximately parallel to the photosensitive member and adapted to provide toner to the photosensitive member;

initial bias force means for producing a bias force urging the developer toward the photosensitive member; and additional bias force means for increasing the bias force urging the developer toward the photosensitive member, wherein the additional bias force means comprises one or more weights attached to the process cartridge.

18. The process cartridge of claim 17, wherein the weights are releasably attached to the process cartridge.

19. A method for manufacturing a process cartridge comprising:

providing a developer half comprising a developer having gap spacers thereon and a toner hopper adapted to provide toner to the developer;

providing a cleaner half comprising a photosensitive member, the cleaner half being rotatably connected to the developer half, the photosensitive member being disposed approximately parallel to the developer and abutting the gap spacers and further being adapted to accept toner from the developer at specified points and transfer the toner to print media;

providing one or more compression springs between the developer half and the cleaner half, the springs providing leverage urging the developer half toward the cleaner half so as to maintain contact between the photosensitive member and the gap spacers at an initial bias force; and abutting one or more shims against one or more of the springs to increase the initial bias force to an increased bias force at least about 10% greater than the initial bias force.

20. The method of claim 19 wherein the increased bias force is at least about 50% greater than the initial bias force.

21. An image forming apparatus for forming images on print media comprising:

an electrophotographic photosensitive drum adapted to accept a charge and form images on print media, charging means for charging the photosensitive drum, a laser adapted to discharge the photosensitive drum in a pattern corresponding to an image to be formed, a toner hopper containing toner;

a motor adapted to drive the photosensitive drum;

a developer disposed approximately parallel to the photosensitive drum, the developer being rotatably interconnected with the photosensitive drum and further being adapted to transfer toner from the toner hopper to the photosensitive drum, the photosensitive drum further adapted to transfer toner to the print media, fusing means for fusing toner transferred from the photosensitive drum to the print media;

one or more springs adapted to provide a bias force urging the photosensitive drum and the developer together; and bias force increasing means adapted to increase the bias force by at least about 10%.

* * * * *